US007310945B2

(12) United States Patent
Gurski et al.

(10) Patent No.: US 7,310,945 B2
(45) Date of Patent: Dec. 25, 2007

(54) WORK-SPACE PRESSURE REGULATOR

(75) Inventors: Thomas Q. Gurski, Goffstown, NH (US); Christopher C. Langenfeld, Nashua, NH (US); Stanley B. Smith, III, Raymond, NH (US)

(73) Assignee: New Power Concepts LLC, Manchester, NH (US)

( * ) Notice: Subject to any disclaimer, the term of this patent is extended or adjusted under 35 U.S.C. 154(b) by 603 days.

(21) Appl. No.: 10/774,198

(22) Filed: Feb. 6, 2004

(65) Prior Publication Data

US 2005/0175468 A1 Aug. 11, 2005

(51) Int. Cl.
*F01B 29/10* (2006.01)

(52) U.S. Cl. ..... 60/522; 60/524

(58) Field of Classification Search ..... 60/517, 60/521, 522, 524
See application file for complete search history.

(56) References Cited

U.S. PATENT DOCUMENTS

| | | | | |
|---|---|---|---|---|
| 55,516 | A | 6/1866 | Winans et al. | |
| 120,222 | A | 10/1871 | Van Emon | |
| 124,805 | A | 3/1872 | Fryer | |
| 321,313 | A | 6/1885 | Pinkham | |
| 488,373 | A | 12/1892 | Touch | |
| 646,406 | A | 4/1900 | Anderson et al. | |
| 1,089,651 | A | 3/1914 | Kovalavich | |
| 1,769,375 | A | 7/1930 | Leary | |
| 1,831,574 | A | 11/1931 | Norton | |
| 1,840,389 | A | 1/1932 | Eubank | |
| 1,866,702 | A | 7/1932 | Gehres | |
| 2,170,099 | A | 8/1939 | Stubings | |
| 2,176,657 | A | 10/1939 | Finch | |
| 2,289,984 | A | 7/1942 | Mouromtseff et al. | |
| 2,337,294 | A | 12/1943 | Cooper | |
| 2,419,234 | A | 4/1947 | Holihan | |
| 2,564,100 | A | 8/1951 | Du Pré | |
| 2,595,457 | A | 5/1952 | Holm et al. | |
| 2,688,228 | A | 9/1954 | De Brey et al. | |
| 3,059,418 | A | 10/1962 | Johnston | |
| 3,092,091 | A * | 6/1963 | Bosley | 123/574 |
| 3,293,480 | A | 12/1966 | Green et al. | |

(Continued)

FOREIGN PATENT DOCUMENTS

DE 445033 5/1927

(Continued)

OTHER PUBLICATIONS

Eder, F., *Apparatus for Heat Transfer at Elevated Temperature, to the Working Medium of a Regenerative Thermal Engine* (*or "energy engine"*).

(Continued)

*Primary Examiner*—Hoang Nguyen
(74) *Attorney, Agent, or Firm*—Bromberg & Sunstein LLP

(57) ABSTRACT

A device and method for equalizing the pressure between work-space and crankcase in a pressurized engine, such as a Stirling engine. The device consists of a two-way valve connected between the work-space and the crankcase. The valve is connected to the work-space with a passageway including a constriction to provide an mean pressure for monitoring purposes. The valve connects the work-space and crankcase allowing the pressure to equalize when the mean pressure of the work-space exceeds the crankcase pressure by a predetermined amount.

20 Claims, 5 Drawing Sheets

U.S. PATENT DOCUMENTS 3,431,788 A 3/1969 De Pré et al.
3,742,578 A 7/1973 Dirne et al.
3,775,973 A 12/1973 Hudson
3,782,457 A 1/1974 Troy
3,860,384 A 1/1975 Vulliet et al.
3,861,223 A 1/1975 Braun
3,924,477 A 12/1975 Portelance
3,940,933 A 3/1976 Nystrom
4,008,039 A 2/1977 Compton et al.
4,020,635 A 5/1977 Joynes et al.
4,041,592 A 8/1977 Kelm
4,067,191 A 1/1978 Gronvall et al.
4,085,588 A 4/1978 Reams et al.
4,169,692 A 10/1979 McDonough et al.
4,172,363 A 10/1979 Bex
4,179,891 A * 12/1979 Gronvall ..... 60/521
4,191,241 A 3/1980 Brennan
4,231,222 A 11/1980 Fenton
4,305,457 A 12/1981 Cozzolino
4,313,080 A 1/1982 Park
4,330,260 A 5/1982 Jorgensen et al.
4,330,992 A 5/1982 Senft
4,343,350 A 8/1982 Campbell et al.
4,364,724 A 12/1982 Alpkvist
4,384,457 A 5/1983 Harvey
4,387,568 A 6/1983 Dineen
4,413,475 A 11/1983 Moscrip
4,416,114 A 11/1983 Martini
4,434,617 A 3/1984 Walsh
4,442,670 A * 4/1984 Goldman ..... 60/517
4,445,570 A 5/1984 Retallick
4,511,805 A 4/1985 Boy-Marcotte et al.
4,527,394 A 7/1985 Corey
4,538,677 A 9/1985 Bódás et al.
4,573,320 A 3/1986 Kralick
4,633,667 A 1/1987 Watanabe et al.
4,662,176 A 5/1987 Fujiwara et al.
4,676,202 A 6/1987 Johnson
4,736,586 A 4/1988 Kawajiri et al.
4,768,341 A 9/1988 Nozaki et al.
4,824,149 A 4/1989 Reuchlein
4,881,372 A 11/1989 Naito
4,898,041 A 2/1990 Islas
4,901,790 A 2/1990 Meijer
4,977,742 A 12/1990 Meijer
4,996,841 A 3/1991 Meijer et al.
5,003,777 A 4/1991 Berchowitz
5,005,349 A 4/1991 Momose et al.
5,065,579 A 11/1991 Monahan
5,074,114 A 12/1991 Meijer et al.
5,095,701 A 3/1992 Nakano
5,148,066 A 9/1992 Beale et al.
5,174,117 A 12/1992 Naito et al.
5,177,968 A * 1/1993 Fellows ..... 60/525
5,199,722 A 4/1993 Wada et al.
5,203,170 A 4/1993 Naito
5,228,293 A 7/1993 Vitale
5,441,401 A 8/1995 Yamaguro et al.
5,494,135 A 2/1996 Brackett
5,522,214 A 6/1996 Beckett et al.
5,590,526 A 1/1997 Cho
5,596,262 A 1/1997 Boll
5,642,618 A 7/1997 Penswick
5,675,974 A 10/1997 Heikrodt et al.
5,682,845 A * 11/1997 Woody ..... 123/73 A
5,697,430 A 12/1997 Thors et al.
5,735,681 A 4/1998 Cheng
5,743,091 A 4/1998 Penswick et al.
5,755,100 A 5/1998 Lamos
5,761,985 A 6/1998 Stoll
5,771,694 A 6/1998 Houtman et al.
5,786,640 A 7/1998 Sakai et al.
5,804,947 A 9/1998 Nii et al.
5,864,770 A 1/1999 Ziph et al.
5,875,863 A 3/1999 Jarvis et al.
5,878,570 A 3/1999 Reithofer
5,881,800 A 3/1999 Chung
5,920,133 A 7/1999 Penswick et al.
5,921,764 A 7/1999 Marchionna et al.
5,929,538 A 7/1999 O'Sullivan et al.
5,945,808 A 8/1999 Kikuchi et al.
5,952,813 A 9/1999 Ochiai
5,954,039 A 9/1999 Doering et al.
6,050,092 A 4/2000 Genstler et al.
6,062,023 A 5/2000 Kerwin et al.
6,161,381 A 12/2000 Lohrmann
6,161,610 A 12/2000 Azar
6,247,310 B1 6/2001 Norris et al.
6,253,550 B1 7/2001 Langenfeld et al.
6,347,453 B1 2/2002 Mitchell
6,381,958 B1 5/2002 Kamen et al.
6,457,462 B2 * 10/2002 Moren ..... 123/572
6,543,215 B2 4/2003 Langenfeld et al.

FOREIGN PATENT DOCUMENTS

DE 1528714 3/1977
DE 35 00 124 A1 7/1986
DE 37 34 009 A1 10/1987
DE G 84 11 960.8 8/1988
DE 39 34 545 A1 5/1991
DE 40 18 943 A1 12/1991
DE 41 02 306 A1 8/1992
DE 42 05 283 A1 8/1993
DE 42 19 583 A1 12/1993
DE 43 08 888 A1 9/1994
DE 295 20 864 U 1 5/1996
DE 198 20 192 A1 11/1998
EP 0 458 115 A1 5/1991
EP 0 607 154 B1 7/1992
FR 1063612 12/1953
FR 2 067 119 8/1971
FR 2 609 154 7/1988
FR 2 721 982 6/1994
GB 395374 7/1933
IT 500313 11/1954
JP 55037540 3/1980
JP 58-25556 8/1981
JP 56-133597 10/1981
JP 58117995 7/1983
JP 61128024 6/1986
JP 63068759 3/1988
JP 02021123 1/1990
JP 02091463 3/1990
JP 02256856 10/1990
JP 03009058 1/1991
JP 04347410 12/1992
JP 07151402 6/1995
JP 07293334 11/1995
JP 09015197 1/1997
NL 675161 7/1952
NL 689484 3/1953
NL 704002 2/1954
NL 892962 4/1962
WO WO 90/08891 8/1990
WO WO 91/05949 5/1991
WO WO 99/40310 8/1999
WO WO 00/79114 A1 12/2000

OTHER PUBLICATIONS

Hargreaves, "The Regnerator":, *The Philip's Stirling Engine*, 1991.
*AAVID Thermal Technologies, Inc.*, Product Selection Guide, Jan. 1996.
Fleming, F. et al, *Rapid Recharge Capability of Valve Regulated Lead Acid Batteries for EV & HEV Applications*.
Anderson, C. et al., The Effects of APU Characteristics on the Design of Hybrid Control Strategies for Hybrid Electric Vehicles, *SAE Technical Paper Serie* , Feb. 27-Mar. 2, 1995.
Dickinson, et al., Performance, Management and Testing Requirement for Hybrid Electric Vehicle Batteries, *SAE Technical Paper Series*, Aug. 11-13, 199165.
Hochgraf, C., et al, Engine Control Stategy for a Series Hybrid Electric Vehicle Incorporating Load-Leveling and Computer Controlled Energy Management, *SAE Technical Paper Series,*, Feb. 26-29, 1996.
Oman, H., New Energy Management Technology Gives Hybrid Cars Long Battery Life, *SAE Technical Paper Series*, Aug. 2-5, 1999.
Hobbs, R. Development of Optimized Fast Charge Algorithms for Lead Acid Batteries, *SAE Technical Paper Series*, Mar. 1-4, 1999.
Wiegman, H., Battery State Control Techniques for Charge Sustaining Applications, *SAE Technical Paper Series*, Feb. 23-26, 1998.

* cited by examiner

WORK-SPACE PRESSURE REGULATOR

TECHNICAL FIELD

The present invention pertains to regulating the pressure in the work-space of a pressurized engine, such as a Stirling engine.

BACKGROUND OF THE INVENTION

Stirling cycle machines, including engines and refrigerators, have a long technological heritage, described in detail in Walker, *Stirling Engines*, Oxford University Press (1980), and incorporated herein by reference. The principle underlying the Stirling cycle engine is the mechanical realization of the Stirling thermodynamic cycle: isovolumetric heating of a gas within a cylinder, isothermal expansion of the gas (during which work is performed by driving a piston), isovolumetric cooling, and isothermal compression.

A Stirling cycle engine operates under pressurized conditions. Stirling engines contain a high-pressure working fluid, preferably helium, nitrogen or a mixture of gases at 20 to 140 atmospheres pressure. A Stirling engine may contain two separate volumes of gases, a working gas volume containing the working fluid, called a work-space or working space, and a crankcase gas volume, the gas volumes separated by piston seal rings. The crankcase encloses and shields the moving portions of the engine as well as maintains the pressurized conditions under which the Stirling engine operates (and as such acts as a cold-end pressure vessel). A pressurized crankcase removes the need for high pressure sliding seals to contain the work-space working fluid and halves the load on the drive component for a given peak-to-peak work-space pressure, as the work-space pressure oscillates about the mean crankcase pressure. The power output of the engine is proportional to the peak-to-peak work-space pressure while the load on the drive elements is proportional to the difference between the work-space and the crankcase pressures. FIG. 1 shows typical pressures in the gas volumes for such an engine.

The action of the piston rings can raise or lower the mean working pressure above or below the crankcase pressure, substantially mitigating the above-mentioned advantages of a pressurized crankcase. For example, manufacturing marks, deviations and molding details of the rings can produce preferential gas flow in one direction between the work-space and the crankcase. The resulting difference in pressure between the work-space and the crankcase can produce as much as double the load on engine, while peak-to-peak pressure and thus engine power increases only fractionally (see, e.g., FIG. 2). In summary, pumping up the workspace mean pressure significantly increases engine wear with only a small attendant increase in power production.

SUMMARY OF THE INVENTION

In embodiments of the present invention, a device is provided that reduces the mean pressure difference between a work-space and a pressurized engine crankcase of an engine, such as a Stirling engine. The device includes a valve connecting the work-space and crankcase of the engine. The pressure difference between work-space and crankcase is monitored. When the mean pressure of the work-space differs from the crankcase pressure by a predetermined amount, the valve opens, allowing the pressure difference between the two spaces to equalize. When the pressure difference between the spaces is reduced sufficiently, the valve closes, isolating the work-space from the crankcase. This closure maximizing power production, while minimizing wear on drive components.

In a specific embodiment of the invention, pressure at which the valve opens is determined by a preloaded spring. In a further specific embodiment of the invention, the mean pressure is monitored by including a constriction in the passageway from the valve to the work-space so that a mean work-space pressure is presented to a pressure monitoring device. In a further specific embodiment of the invention, the device further includes a constriction in the passageway from the crankcase to the pressure monitoring device such that the monitoring device is presented with a mean crankcase pressure.

BRIEF DESCRIPTION OF THE DRAWINGS

The invention will be more readily understood by reference to the following description, taken with the accompanying drawings, in which.

DETAILED DESCRIPTION OF PREFERRED EMBODIMENTS

Figure 1:
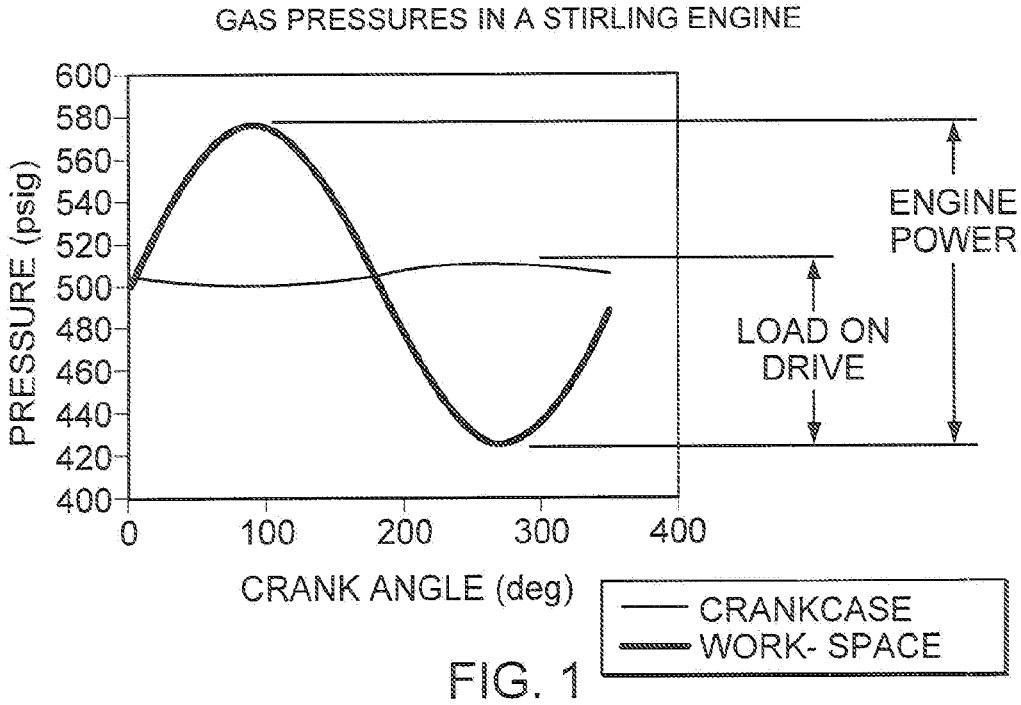
FIG. 1 shows a graph of work-space and crank-case pressure for a Stirling engine with a pressurized crankcase.
Figure 2:
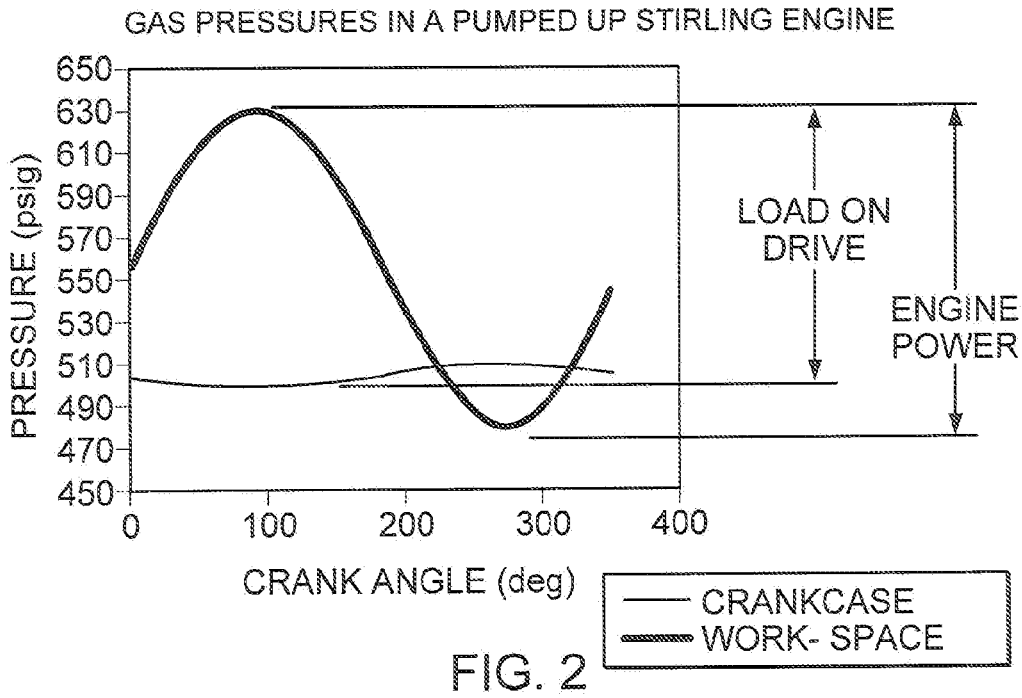
FIG. 2 shows a graph of pressure between a work-space and a crankcase for a Stirling engine when the work-space is pumped-up.
Figure 3:
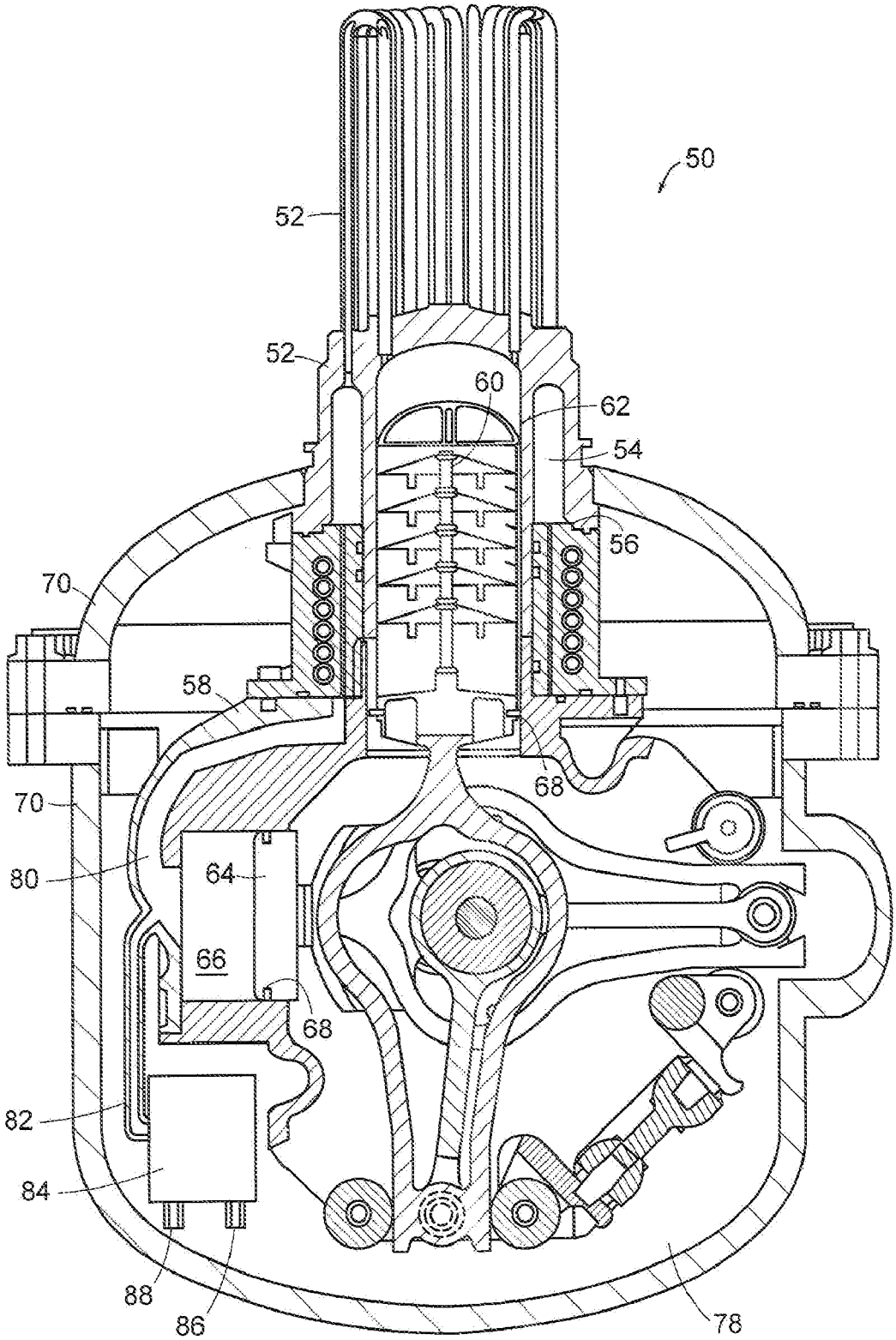
FIG. 3 shows a side view in cross section of a sealed Stirling cycle engine.

In embodiments of the present invention, a device is provided that reduces the pressure difference between a work-space and a pressurized engine crankcase of an engine, such as a Stirling engine. Referring to FIG. 3, a sealed Stirling cycle engine 50 is shown in cross section. While this embodiment of the present invention will be described with reference to the Stirling engine shown in FIG. 3, it should be understood that other engines, coolers, and similar machines may likewise benefit from embodiments of the present invention and such combinations are within the scope of the invention, as described in the appended claims. A sealed Stirling cycle engine operates under pressurized conditions. Stirling engine 50 contains a high-pressure working fluid, preferably helium, nitrogen or a mixture of gases at 20 to 140 atmospheres pressure. Typically, a crankcase 70 encloses and shields the moving portions of the engine as well as maintains the pressurized conditions under which the Stirling engine operates (and acts as a cold-end pressure vessel.) A heater head 52 serves as a hot-end pressure vessel.

Stirling engine 50 contains two separate volumes of gases, a working gas volume 80 and a crankcase gas volume 78, that will be called hereinafter, a "work-space" and a "crankcase," respectively. These volumes are separated by piston rings 68, among other components. In the work-space 80, a working gas is contained by a heater head 52, a regenerator 54, a cooler 56, a compression head 58, an expansion piston 60, an expansion cylinder 62, a compression piston 64 and a compression cylinder 66. The working gas is contained outboard of the piston seal rings 68. The crankcase 78 contains a separate volume of gas enclosed by the cold-end pressure vessel 70, the expansion piston 60, and the compression piston 64. The crankcase gas volume is contained inboard of the piston seal rings 68.

In the Stirling engine 50, the working gas is alternately compressed and allowed to expand by the compression piston 64 and the expansion piston 60. The pressure of the working gas oscillates significantly over the stroke of the pistons. During operation, fluid may leak across the piston seal rings 68 because the piston seal rings 68 do not make a perfect seal. This leakage results in some exchange of gas between the work-space and the crankcase. A work-space pressure regulator ("WSPR") 84 serves to restore the pressure balance between the work-space and the crankcase. In embodiments of the invention, the WSPR is connected to the work-space by passageway 82, which may be a pipe or other equivalent connection, and to the crankcase by another passageway 86. When the work-space mean pressure 80 differs sufficiently from the mean crankcase pressure, the WSPR connects the two volumes via vent, 88 until the differential between the mean pressures diminishes.

Figure 4:
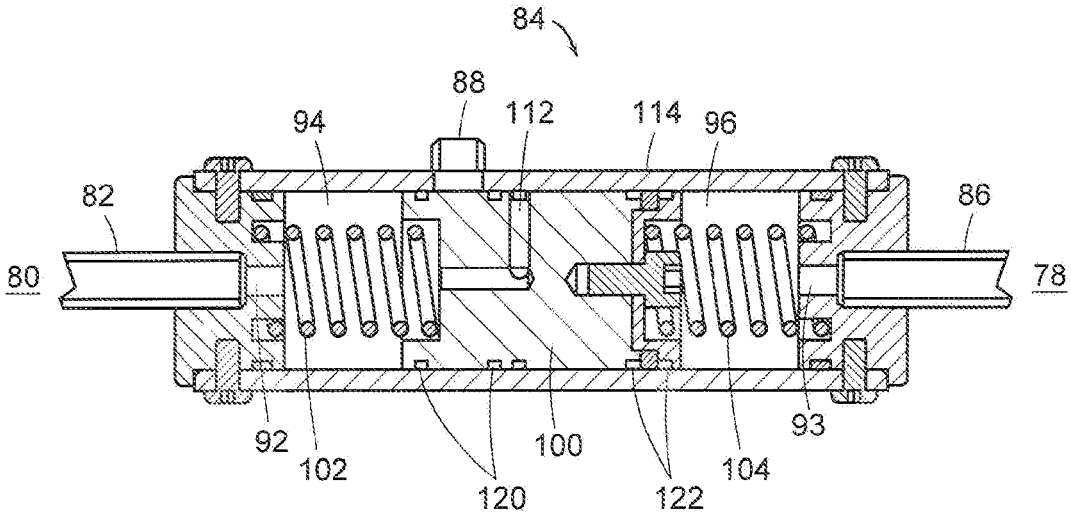
FIG. 4 shows a pressure regulator for an engine according to an embodiment of the invention.

For example, an exemplary work-space pressure regulator is shown in FIG. 4. Pipe or passageway 82 connects the pressure regulator 84 to the work-space 80. A restrictive orifice 92 damps the oscillating work-space pressure applying the mean work-space pressure to one end of the shuttle, 100. The orifice 92 is sized to be significantly larger than the piston seal ring leak. As used in this specification including any appended claims, the term "constriction" will be used to denote a narrowing in a pipe or passageway, including such a constriction at the end of a pipe or passageway or any place within the pipe or passageway. The other end of the shuttle 100 is exposed to the crankcase pressure via a pipe 86, which pipe may include a restrictive orifice 93 or other constriction. Orifice 93 may be sized much smaller than orifice 92, in which case the combination of the shuttle 100 and the orifice 93 act to damp movement of the shuttle from work-space pressure swings applied through orifice 92. In a specific embodiment of the invention, orifice 92, from WSGR to work-space is approximately 0.031 inches in diameter, while orifice 93, from WSGR to the crankcase, is approximately 0.014 inches in diameter. In other embodiments of the invention, the constriction from shuttle to crankcase may be omitted. Note that the crankcase pressure is approximately constant over the piston's cycle, while the work-space pressure swings significantly during the cycle. Two springs 102, 104 keep the shuttle 100 centered, when the mean work-space and the crankcase pressures are equal.

When the mean work-space pressure is higher than the crankcase pressure, the higher pressure moves the shuttle 100 to the right, compressing spring 104. If the pressure difference is large enough to expose port 88 the work-space and the crankcase become connected. Some of the work-space gas flows into the crankcase until the two mean pressures are equalized, which allows the shuttle 100 to return to the original position, closing the port 88. Note that orifice from the work-space to the WSGR 92 may be sized to allow the pressure to equalize between work-space and crankcase quickly when port 88 is exposed, while still small enough to present a mean work-space pressure to the shuttle 100.

When the mean crankcase pressure is higher than the work-space pressure, the shuttle will move to the left, compressing spring 102. If the pressure difference is large enough, port 88 will be exposed to channel 112, connecting space 94 with the crankcase 78. Some of the crankcase gas flows into the work-space until the two mean pressures are equalized, which allows the shuttle 100 to return to its centered position, closing port 88.

The shuttle isolates the work-space 80 from the crankcase 78 in its centered position. The seal may be provided by two cup seals 122 located at the end of shuttle nearest the crankcase vent 86 or by equivalent seals as are known in the art. Two ring seals 120 center and guide the shuttle 88 in the WSPR body 114.

Figure 5:
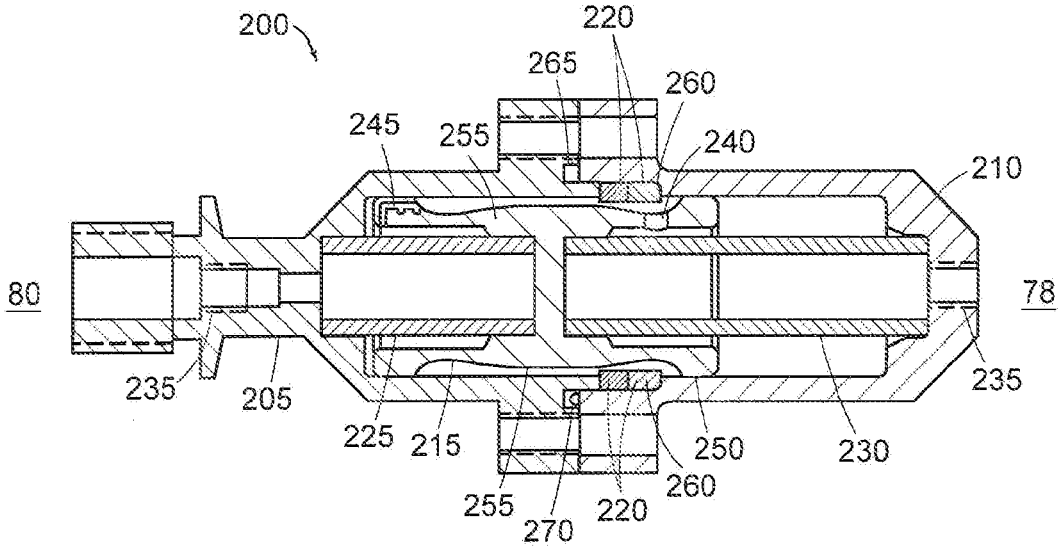
FIG. 5 shows a pressure regulator for an engine according to another embodiment of the invention.

Another embodiment of the invention is shown in FIG. 5 and labeled generally 200. Work-space housing 205 and crankcase housing 210 are bolted together capturing piston 215, work-space spring 225, and crankcase spring 230 in their bores. The interface of the two housings creates cup seal gland 260 into which seats a bidirectional cup seal 220, and an O-ring gland 265 into which seats an O-ring 270. The O-ring seals the interior of the housings from the crankcase pressure. Two orifices 235 allow the pressures inside the two housings to remain equal to the mean crankcase pressure and the mean work-space pressure, respectively, without large pressure oscillations or large mass flows into/out of the housings. The piston is free to move axially within the housings by sliding on its bearing surfaces 250.

When the two pressures are equal, the springs keep the piston centered such that the cup seal seals against the piston's sealing surface 255, preventing any flow between the two housings. When the pressure differential between the two housings becomes great enough, the force imbalance on the piston will cause the piston to move away from the region of high pressure, compressing the spring on the low-pressure side and relaxing the spring on the high-pressure side. Equilibrium is reached when the pressure force imbalance equals the spring force imbalance. If the pressure differential is great enough, the piston will be displaced enough that the cup seal 220 no longer contacts the sealing surface and instead loses sealing force against the decreasing diameter of the piston. Once the seal is broken, gas can flow from the high-pressure side, through the vent hole 240 or vent slot 245, past the cup seal 220, and into the adjacent housing. Gas will continue to flow until the pressure has equalized enough for the springs to return the piston to a position where the cup seal 220 seals against the sealing surface 255.

Figure 6:
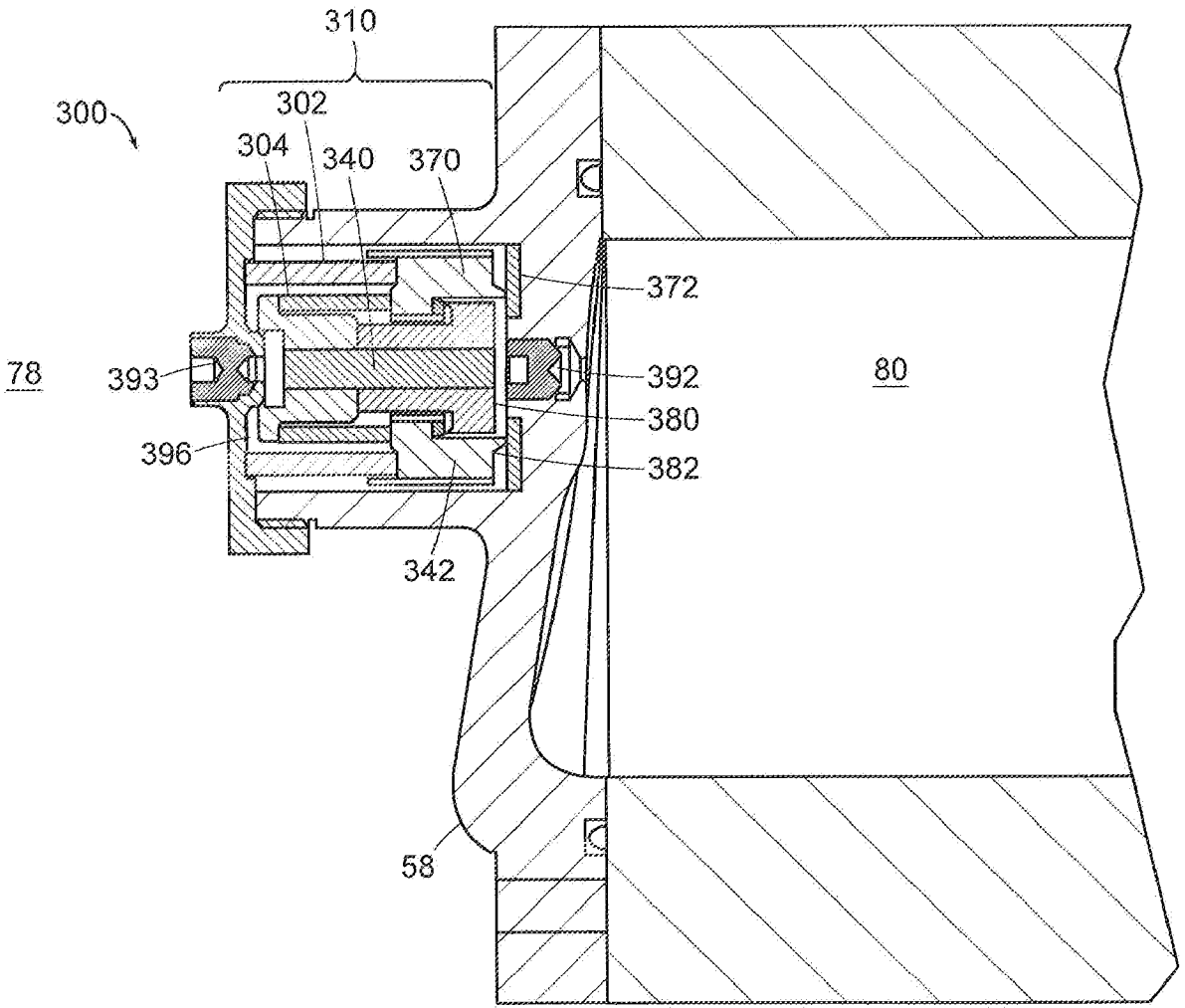
FIG. 6 shows a pressure regulator for an engine according to a further embodiment of the invention.

Another embodiment of the invention is shown in FIG. 6 and will be referred to as the Preloaded WSPR (300). This embodiment of the invention uses preloaded springs 302, 304 connected to an inner piston 340 and an outer piston 342 to control working gas flow into and out of the work-space 80. The springs are open-coil springs and, thus, gas flows freely through these springs. WSPR 300 communicates with the work-space 80 via an orifice 392. Likewise, the crankcase volume 78 is connected to WSPR 300 via port 393. Work-space pressure oscillations are damped out by the constriction of the orifice 392 together with the force of the pre-loaded springs 302, 304 acting on the pistons 340, 342. Seals 370, 372 provide a compliant seat for pistons 340, 342. The orifice 392 is sized to be significantly larger than the piston seal ring leak. WSPR 300 may be mounted on the compression cylinder head of the engine 58 (see FIG. 3).

The Preloaded WSPR relieves a mean overpressure in the work-space in the following manner. The oscillating work-space pressure, which is partially damped by the orifice 392, is applied to the face 380 of the inner piston 340 and to the face of the outer piston 342 that are proximate to the work-space. If the net mean pressure on the pistons is enough to overcome the preload on spring 302, then the inner and outer pistons move to the left and open the valve at 382. The released gas flows past the open seal at 382 around the outside of the outer piston 342, through spring 302 and into the crankcase via port 393. Once the difference between the work-space and the crankcase pressures drops below the preload on spring 302, the outer piston 342 moves back to the right and seals at 382. Seal 372 provides a compliant seat for piston 342.

The Preloaded WSPR relieves excess crankcase pressure by a similar method. When the net pressure times the inner piston's 340 area is greater than the preload on spring 304, the inner piston 340 moves to the right and opens the valve at 370, which provides a compliant seal for the inner piston 340. Gas from the crankcase flows between the outer and inner pistons and into the work-space via the orifice at 392 reducing the pressure differential. Once the difference between the work-space and the crankcase pressures drops below the preload on spring 304, the inner piston 340 moves back to the left and seals at 370.

In another preferred embodiment of the invention, the preloads in springs 302 and 304 may be preloaded to different force levels. The different forces applied by the springs would allow the workspace pressure to "pump-up" (i.e., increase) reaching a higher mean pressure, thereby allow the engine to produce higher mechanical power. This embodiment allows the design to add engine power without raising the crankcase mean pressure. Thus the power can be increased without redesigning or perhaps requalifying the crankcase pressure vessel.

Figure 7:
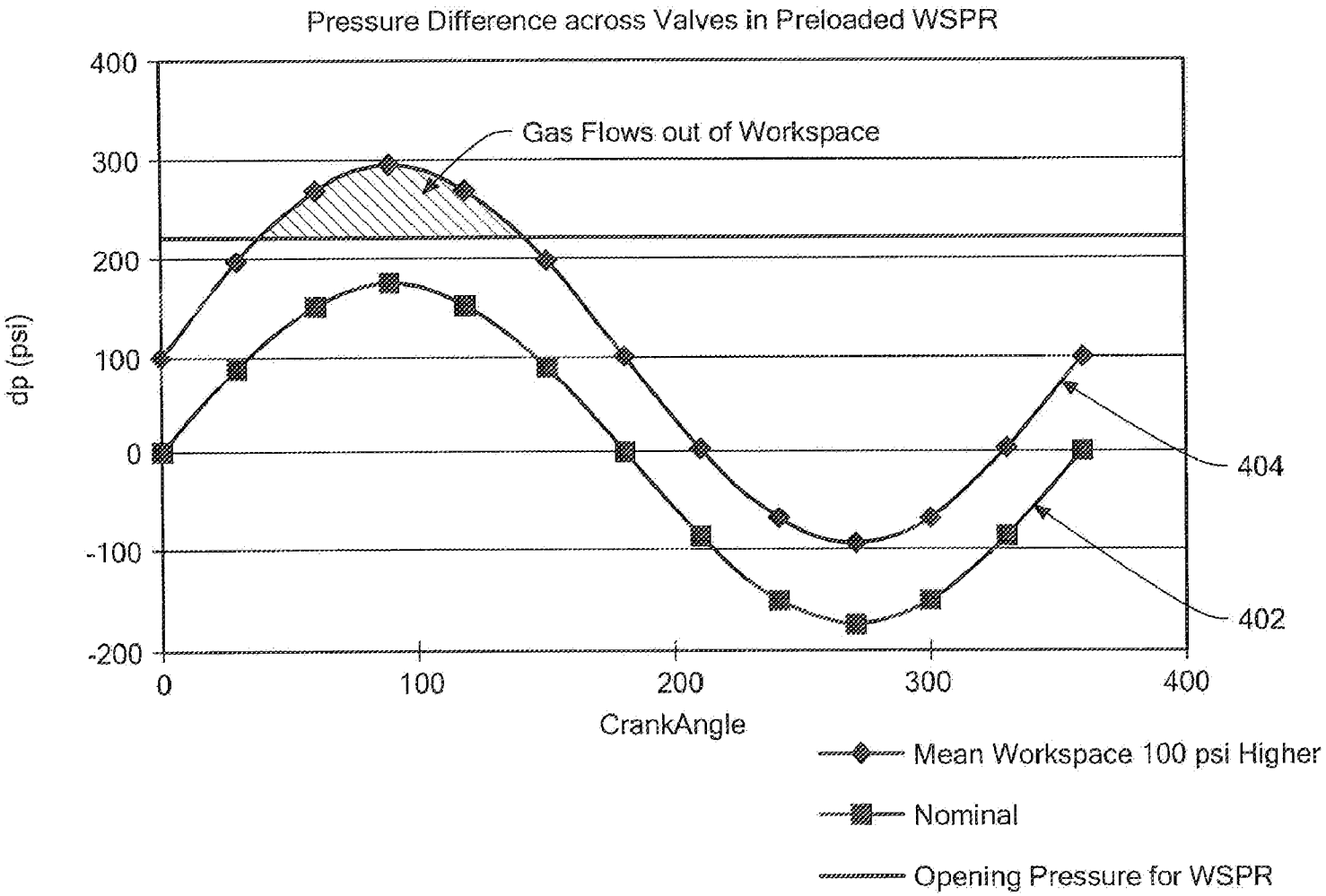
FIG. 7 shows the pressure difference that may develop across a valve according to the embodiment shown in FIG. 6.

The functioning of the Preloaded WSPR can be understood by considering the pressures difference between the two orifices 392 and 393 in FIG. 6. As an example, consider the pressure across valve 310, as shown in FIG. 7. (It should be noted that FIG. 7 is exemplary only and does not represent measured data on a WSPR.) The pressure difference between the two orifices can be better described as the pressure difference across regulator valve 310 where the regulator valve is composed of the two pistons 340, 342, the two springs 302, 304 and the two valve seats 370, 372. FIG. 7 shows the pressure across valve 310 for two cases. In one case, the preload on each spring 302, 304 is the same, and the workspace does not "pump-up," as shown by graph 402. The workspace and crank case remain at approximately the same mean pressure. In the second case, the preload on spring 302 is greater than the preload on spring 304. Graph 404 shows the pressure across the valves, when the work-space has a mean pressure that is 100 psi above the crankcase pressure. In the latter case, the pressure difference may become large enough to overcome the preload on valve 302, opening valve 310 and allowing gas to flow out of the workspace into the crankcase, reducing the pressure in the workspace. The horizontal line in FIG. 7 shows the pressure at which the preload on spring 304 is overcome. At that pressure, the WSPR opens allowing gas to pass between workspace and crankcase. The devices and methods described herein may be used in combination with components comprising other engines besides the Stirling engine in terms of which the invention has been described. The described embodiments of the invention are intended to be merely exemplary and numerous variations and modifications will be apparent to those skilled in the art. All such variations and modifications are intended to be within the scope of the present invention as defined in the appended claims

We claim:

1. In an engine of the type having a working space, characterized by a mean pressure, and a sealed crankcase, characterized by a crankcase pressure, an improvement comprising a valve in fluid communication with both the working space and the crankcase, the valve permitting fluid flow between the working space and the crankcase when an absolute value of a difference between the mean working space pressure and the crankcase pressure exceeds a specified value.

2. A device according to claim 1 wherein the engine is a Stirling cycle engine.

3. A device according to claim 1 wherein the pressure difference is the difference between the mean working space pressure and a mean crankcase pressure.

4. A device according to claim 1 wherein the valve connection to the working space includes a constriction.

5. A device according to claim 4 wherein the valve connection to the crankcase includes a constriction.

6. A device according to claim 5, wherein the constriction in the valve connection to the crankcase is smaller than the constriction in the valve connection to the working space.

7. A device according to claim 1, wherein a pressure at which the valve opens is determined by a preloaded spring.

8. A device according to claim 1, wherein the device includes a piston to damp pressure oscillations.

9. In an engine of the type having a working space, characterized by a mean pressure, and a sealed crankcase, characterized by a crankcase pressure, an improvement comprising:

a valve in fluid communication with both the working space and the crankcase, the valve permitting fluid flow from the working space to the crankcase when the working space pressure exceeds the crankcase pressure by a first specified value and permitting fluid flow from the crankcase to the working space when the crankcase pressure exceeds the working space pressure by a second specified value.

10. A device according to claim 9 wherein the first specified value exceeds the second specified value.

11. A method for minimizing a pressure difference between a working space and a sealed crankcase in an engine, the method comprising:

a. monitoring a pressure difference between the working space and the crankcase and;

b. opening a valve in fluid communication with the working space and the crankcase when the absolute value of the pressure difference exceeds a specified value.

12. A method according to claim 11 wherein the engine is a Stirling cycle engine.

13. A method according to claim 11 wherein the pressure difference is the difference between the mean working space pressure and the crankcase pressure.

14. A method according to claim 11 wherein the pressure difference is the difference between the mean working space pressure and the mean crankcase pressure.

15. A method according to claim 11 wherein the valve connection to the working space includes a constriction.

16. A method according to claim 11 wherein the valve connection to the crankcase includes a constriction.

17. A method according to claim 11, wherein the valve includes a piston to damp pressure oscillations.

18. A method according to claim 11, wherein a pressure at which the valve opens is determined by a preloaded spring.

19. A method for minimizing a pressure difference between a working space and a sealed crankcase in an engine, the method comprising:

a. monitoring a pressure difference between the working space and the crankcase and;

b. opening a valve in fluid communication with the working space and the crankcase when the working space pressure exceeds the crankcase pressure by a first specified value; and c. opening the valve in fluid communication with the working space and the crankcase when the crankcase pressure exceeds the working space pressure by a second specified value.

20. A method according to claim 19, wherein the first specified value exceeds the second specified value.

* * * * *